US005971261A

United States Patent [19]

Grünfeld et al.

[11] Patent Number: 5,971,261

[45] Date of Patent: Oct. 26, 1999

[54] CARTON AND BLANK FOR FORMING THE SAME

[75] Inventors: Tina Grünfeld, Mölnlycke; Magnus Ny, Varberg, both of Sweden

[73] Assignee: Astra Aktiebolag, Sodertalje, Sweden

[21] Appl. No.: 08/894,995

[22] PCT Filed: Jun. 27, 1997

[86] PCT No.: PCT/SE97/01162

§ 371 Date: Sep. 4, 1997

§ 102(e) Date: Sep. 4, 1997

[87] PCT Pub. No.: WO98/02357

PCT Pub. Date: Jan. 22, 1998

[30] Foreign Application Priority Data

Jul. 12, 1996 [SE] Sweden ..... 9602762

[51] Int. Cl.[6] ..... B65D 5/43

[52] U.S. Cl. ..... 229/102; 206/459.5; 206/807; 229/153; 229/223; 53/473

[58] Field of Search ..... 229/102, 223, 229/151–153; 206/459.5, 767, 768, 807; 40/312; 53/473

[56] References Cited

U.S. PATENT DOCUMENTS

| | | | |
|---|---|---|---|
| 422,792 | 3/1890 | Johnston | 229/151 |
| 1,116,043 | 11/1914 | Elliott | 229/152 |
| 1,871,888 | 8/1932 | Johnson | 206/459.5 |
| 1,888,818 | 11/1932 | Daller | 229/153 |
| 2,359,679 | 10/1944 | Roehrl | 229/152 |
| 3,062,430 | 11/1962 | Rutledge | 206/459.5 |
| 3,591,071 | 7/1971 | Rosenberg, Jr. | 229/223 |
| 4,284,193 | 8/1981 | Roccaforte | 229/151 |

FOREIGN PATENT DOCUMENTS

| | | |
|---|---|---|
| 2249808 | 5/1975 | France . |
| 2104048 | 3/1983 | United Kingdom . |
| 2187169 | 9/1987 | United Kingdom . |

*Primary Examiner*—Gary E. Elkins
*Attorney, Agent, or Firm*—White & Case L.L.P.

[57] ABSTRACT

A carton which is intended especially for drugs, as well as a blank for forming the same. The carton comprises a sleeve portion consisting of at least three wall-forming panels (1,2,4,6) which are interconnected by folding lines (3,5,7) and by a closure tab (8), which is attached to a first wall-forming panel (1) along a folding line (9) and engages a second wall-forming panel (6), ends flaps (10,11;12,13;14,15) attached to the ends of the sleeve portion along folding lines (16,17,18,19,20,21) and closing the ends of the sleeve portion and the carton comprises an additional panel (25), which is connected to one of the wall-forming panels (1,2,4,6) along a folding line (26) and which overlies at least one of the wall-forming panels (1,2,4,6). The use of the carton for carrying at least one pharmaceutically active substance as described.

18 Claims, 4 Drawing Sheets

FIG Ia
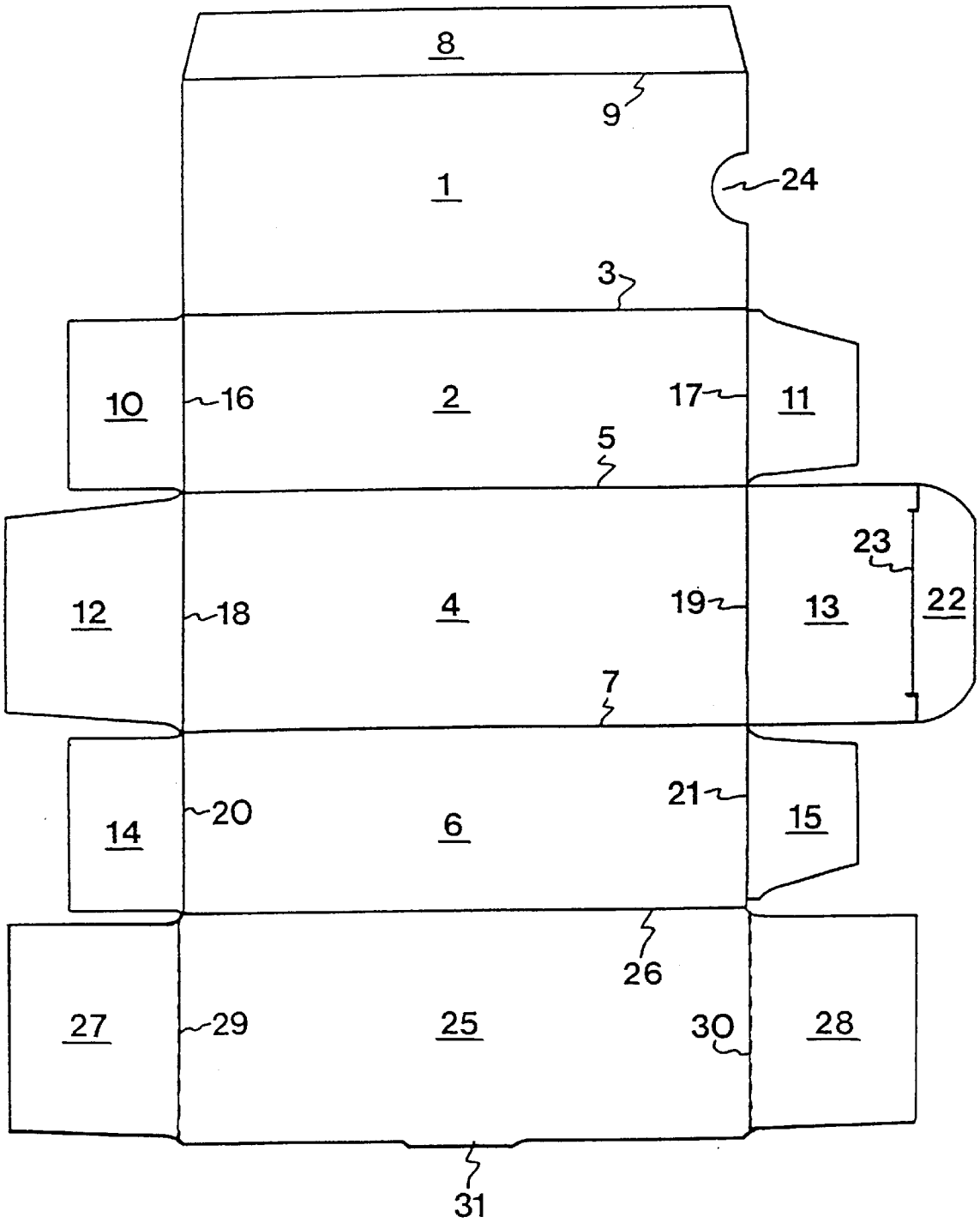

FIG Ib
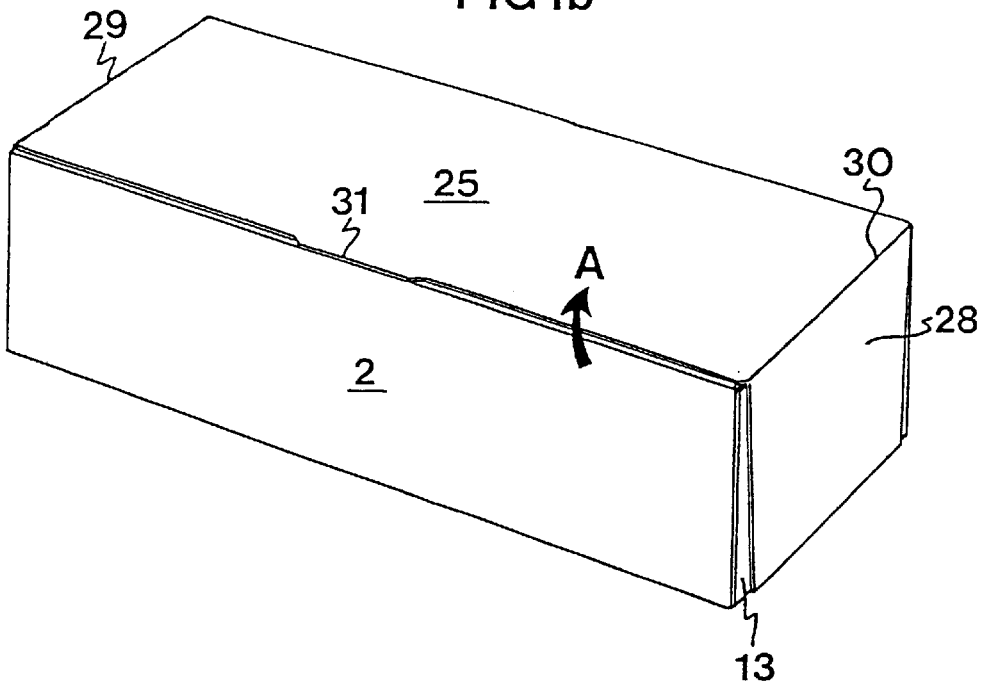
FIG Ic
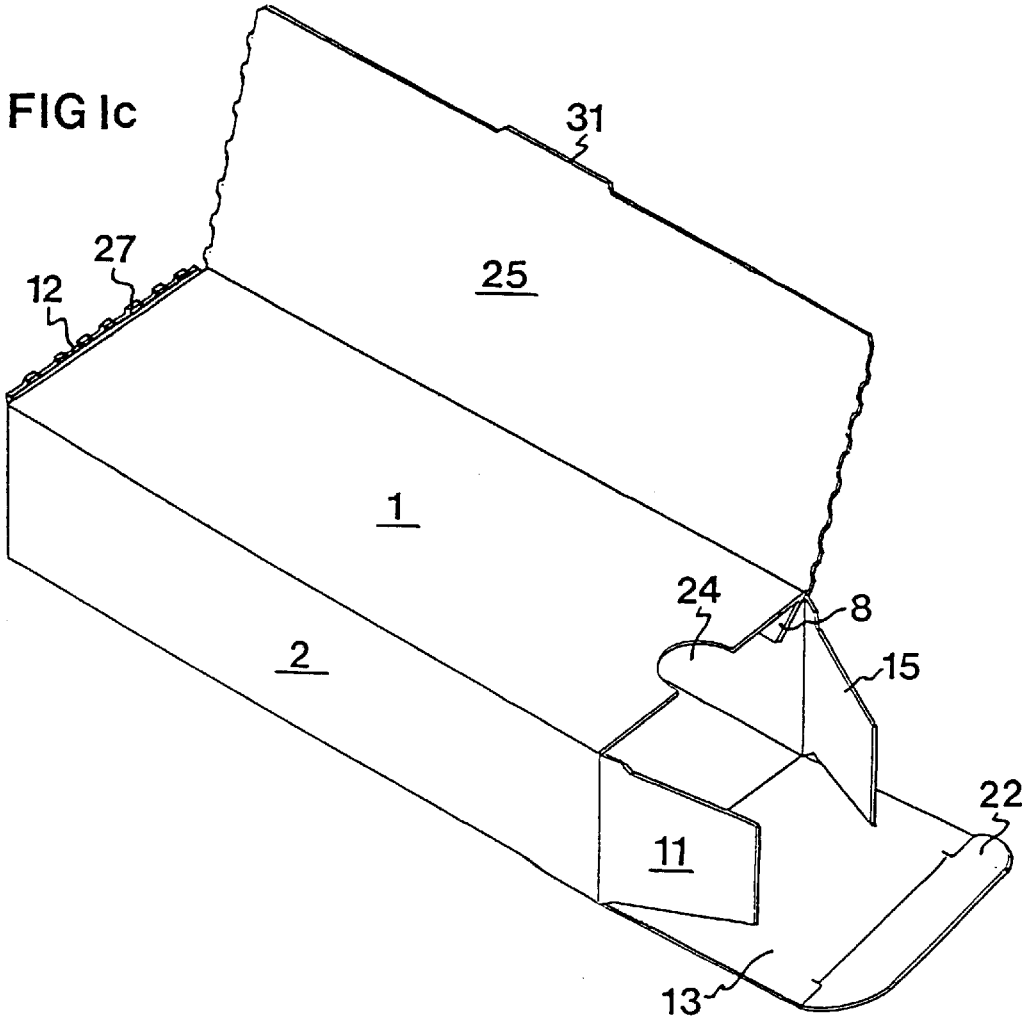

CARTON AND BLANK FOR FORMING THE SAME

FIELD OF THE INVENTION

The present invention relates to a carton, which is intended especially for drugs, as well as a blank for forming the same.

BACKGROUND OF THE INVENTION AND PRIOR ART

Conventionally, drugs are packed in e.g. blister packs, which in turn are stacked in a separate box or carton. This carton has the shape of a rectangular parallelepiped and comprises a sleeve portion consisting of four walls which are interconnected by folding lines. End flaps are connected to the sleeve portion along folding lines in order to close the ends of the carton. Normally, one end of the carton is permanently closed, the end flaps being for example glued to one another. The other end of the carton is closed by means of a tuck-in tab, which is connected along a folding line to one of the end flaps. Consequently, the carton can easily be opened and reclosed at this end, such that the patient can remove a blister pack from the carton. User instructions are generally enclosed in the form of a separate leaflet, which is placed inside the carton.

This kind of tubular carton is made from an essentially rectangular blank having a sleeve-forming portion with four wall-forming panels arranged side by side and being interconnected by folding lines. A closure tab is connected along a folding line to a first wall-forming panel on one side of the sleeve-forming portion. When the carton is erected, the closure tab is engaged, for example by means of adhesive, with a second wall-forming panel on the other side of the sleeve-forming portion. The blank further comprises end flaps, which are connected along folding lines to both ends of the sleeve-forming portion.

One disadvantage of this conventional carton is that all information concerning the drug, e.g. composition, secondary effects, manufacturer, user instructions, etc., is printed on the separate leaflet or folder that accompanies the blister packs in the carton. Thus, the leaflet contains a considerable amount of information, and it will require some effort on the part of the patient to find a certain piece of information, e.g. the user instructions. Due to the difficulty of finding these instructions, it might be impossible for an elderly or confused patient to administer the drug himself. This problem is even more pronounced when the carton contains different drugs that should be administered in combination.

Another drawback of this known carton is that the leaflet is lying loose in the carton. The user might therefore unintentionally lose the only item carrying vital information, or even deliberately throw it away.

A further drawback of this known carton resides in the fact that a receiver, e.g. a patient or a pharmacist, in no way can make sure that the carton has not been opened prior to delivery. Even if a separate seal is attached to the carton, e.g. a piece of tape, this is no guarantee that the contents have not been tampered with.

OUTLINE OF THE INVENTION

The object of the invention is to solve or alleviate some or all of the problems described above. More specifically, the carton according to the invention should enhance the possibility that the patient will comply with the user instructions when taking the drug (patient compliance), and reduce the risk that these instructions may be lost during use.

This object is achieved by the carton and the blank for forming the same set forth in the appended claims.

In addition to the solution to the above-mentioned problems, the invention or its embodiments confer the following advantages, which cannot be obtained with prior-art technique.

- The problems mentioned above will be solved essentially without any change in the outer appearance of the carton. Thus, the patient will confidently recognise the package at the point of sale, e.g. a pharmacy.
- Notwithstanding this lack of change in outer appearance, the carton will, after being opened for the first time, present large areas that can carry particularly important information, such as user instructions, these areas being an integral part of the carton.
- In one preferred embodiment, the carton will be tamper-proof prior to delivery to the patient, since the securing flaps of the additional panel engage the end flaps of the carton. An attempt to illicitly open the carton will therefore result in the break lines to being broken.

BRIEF DESCRIPTION OF THE DRAWINGS

The invention will now be described in more detail with reference to the accompanying drawings, in which FIG. 1*a* is a plan view of a first embodiment of the carton blank, FIG. 1*b* is a perspective view of a carton erected from the blank in FIG. 1*a*, and FIG. 1*c* is a perspective view of the carton in FIG. 1*b* after opening.

Figure 2A:
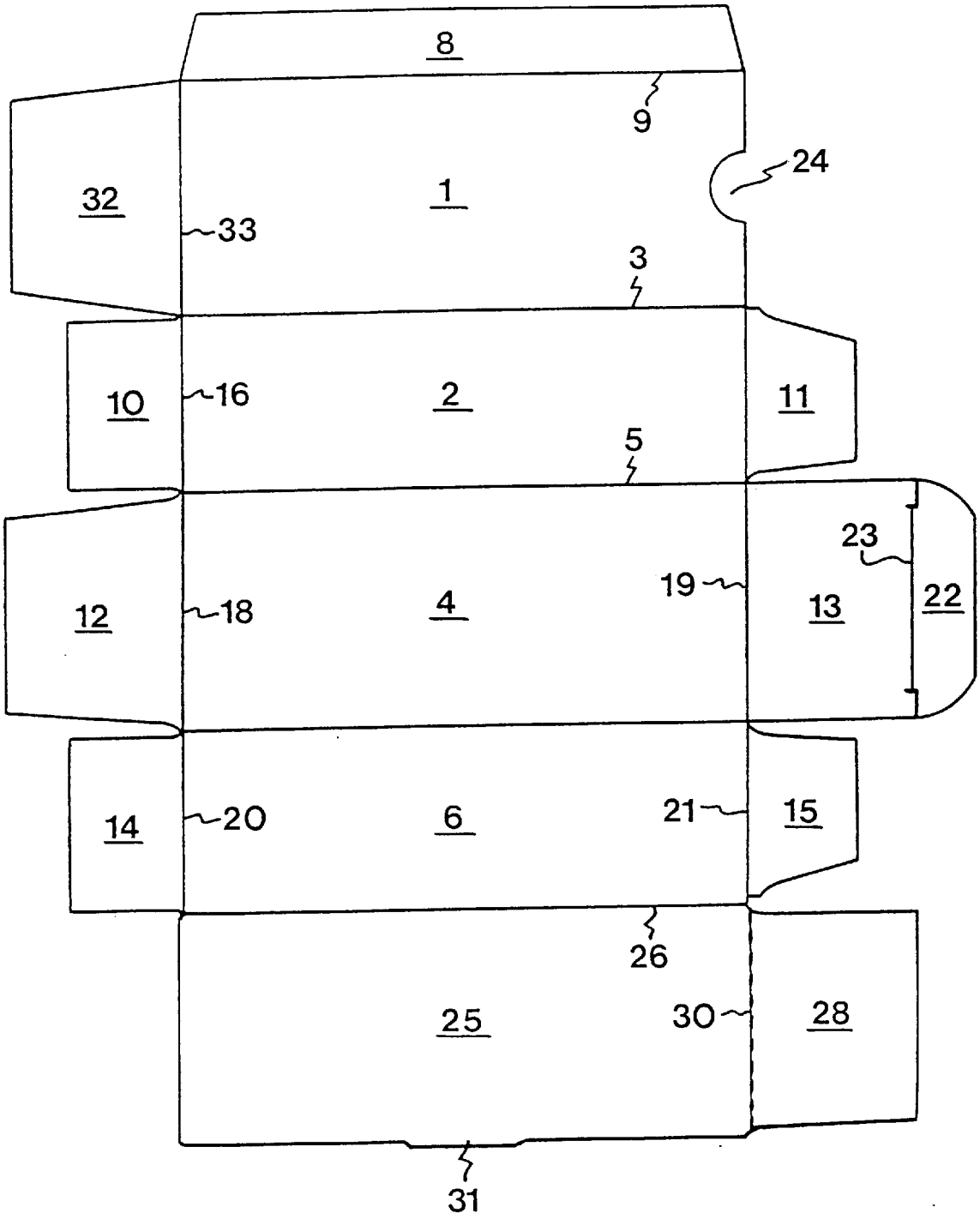
FIG. 2*a* is a plan view of a second embodiment of the carton blank.

The integral blank of FIG. 1*a* has a rectangular sleeve-forming portion consisting of four wall-forming panels which are arranged side by side, namely a top wall panel 1, a first sidewall panel 2 connected to the top wall panel 1 along a first folding line 3, a bottom wall panel 4 connected to the first sidewall panel 2 along a second folding line 5, and a second sidewall panel 6 connected to the bottom wall panel 4 along a third folding line 7, said folding lines 3, 5, 7 being parallel. The top wall panel 1 has essentially the same dimensions as the bottom wall panel 4, and the first sidewall panel 2 has essentially the same dimensions as the second sidewall panel 6. When erected, the blank is thus formed into a rectangular parallelepiped.

On one side of the sleeve-forming portion, a closure tab 8 is connected to the top wall panel 1 along a fourth folding line 9.

At each end of the first sidewall panel 2, the bottom wall panel 4 and the second sidewall panel 6, an end flap 10, 11, 12, 13, 14, 15 is connected to the panel at issue along a folding line 16, 17, 18, 19, 20, 21. One of the end flaps 13 on the bottom wall panel 4 is in turn connected to a tuck-in tab 22 along a folding line 23. In the top wall panel 1, a cut-out 24 is formed on the same end of the sleeve-forming portion as the end flap 13 carrying the tuck-in tab 22.

An additional panel 25 is permanently connected to the second sidewall panel 6 along a fifth folding line 26, said additional panel 25 having essentially the same dimensions as said top wall panel 1. On each end of the additional panel 25, there is provided a securing flap 27, 28, which is connected to the additional panel 25 along a break line 29, 30. The securing flaps 27, 28 essentially have the same size as the end flaps 12, 13 of the bottom wall panel 4. Further, a lug 31 is formed on the additional panel 25 on the side facing away from said fifth folding line 26.

To assemble the carton, the closure tab 8 is coated with adhesive and brought into engagement with the second sidewall panel 6, such that the fourth folding line 9 essentially coincides with the fifth folding line 26. The carton is then erected to form a sleeve, whereupon one end of the sleeve is closed by first folding in the end flaps 10, 14 of the sidewall panels 2, 6 and then folding in the end flap 12 of the bottom wall panel 4. Finally, the securing flap 27 on this end of the carton is folded down so as to overlie and be fixed to the end flap 12 of the bottom wall panel 4, preferably by means of adhesive. Subsequently, the carton is loaded with goods, e.g. blister packs, at the other, open end. After loading, the carton is closed by first folding in the end flaps 11, 15 of the sidewall panels 2, 6 and then folding in the end flap 13 of the bottom wall panel 4, whereby the tuck-in tab 22 is inserted between the end flaps 11, 15 of the sidewall panels 2, 6 and the top wall panel 1 such that the cut-out 24 uncovers part of the tuck-in tab 22. Finally, the securing flap 28 is folded down so as to overlie and be fixed to the end flap 13 of the bottom wall panel 4, preferably by means of adhesive.

In FIG. 1*b*, the carton is shown in erected and sealed condition. It will be appreciated that the carton is tamper-proof in so far as no one can have access to the contents without breaking either of the break lines 29, 30.

The carton in FIG. 1*b* is initially opened by the patient gripping the lug 31 and pulling the additional panel 25 in the direction indicated by arrow A away from the top wall 1, thereby separating the additional panel 25 from the securing flaps 27, 28 along the break lines 29, 30. Then, the carton can be opened in conventional manner by the patient gripping the tuck-in tab 22 through the cut-out 24 and pulling said tab 22 away from the sleeve. A carton that has been thus opened is shown in FIG. 1*c*.

If desired, the carton could obviously have more than one tuck-in tab, namely one at each end of the sleeve.

By using an additional panel 25 according to the invention, large areas are provided on the surface of the top wall 1 as well as the surface of the additional panel 25 facing said top wall 1. In this area, text and/or explanatory drawings can convey the most important user instructions, which consequently can be separated from the general information given on the leaflet.

The fact that the instructions can be printed on the additional panel or the underlying wall, i.e. on an integral part of the carton, alleviates the risk that these instructions will be lost by the patient during treatment.

Further, since the additional panel 25 covers the top wall 1 when the carton is delivered to the patient, the text thereon is hidden and will not disturb or in any way alter the outer appearance of the carton.

Figure 2B:
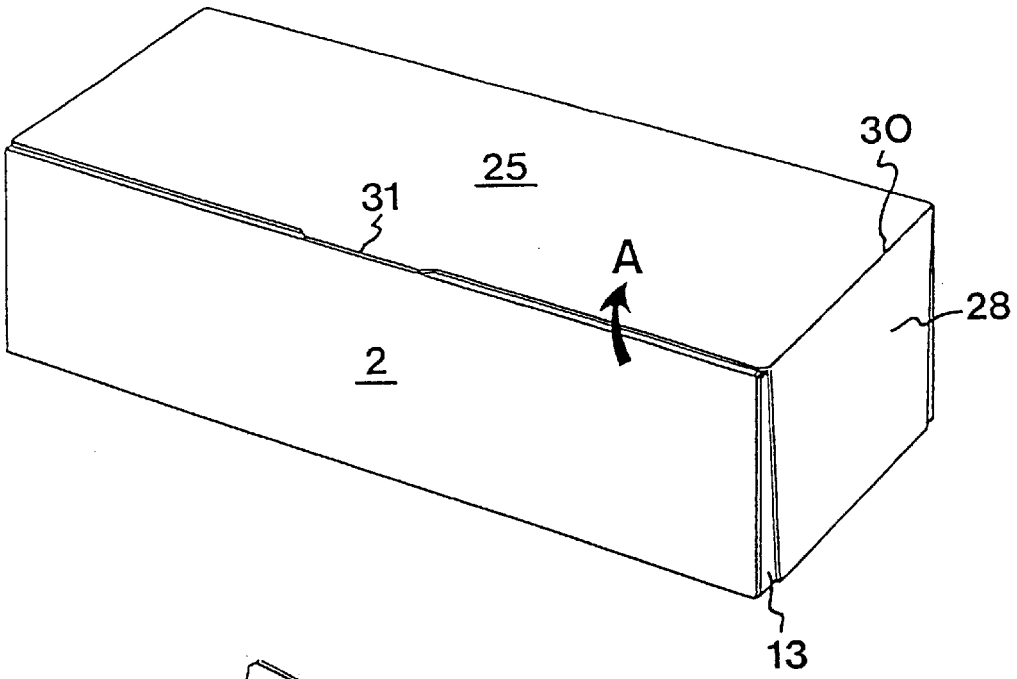
FIG. 2*b* is a perspective view of a carton erected from the blank in FIG. 2*a*.
Figure 2C:
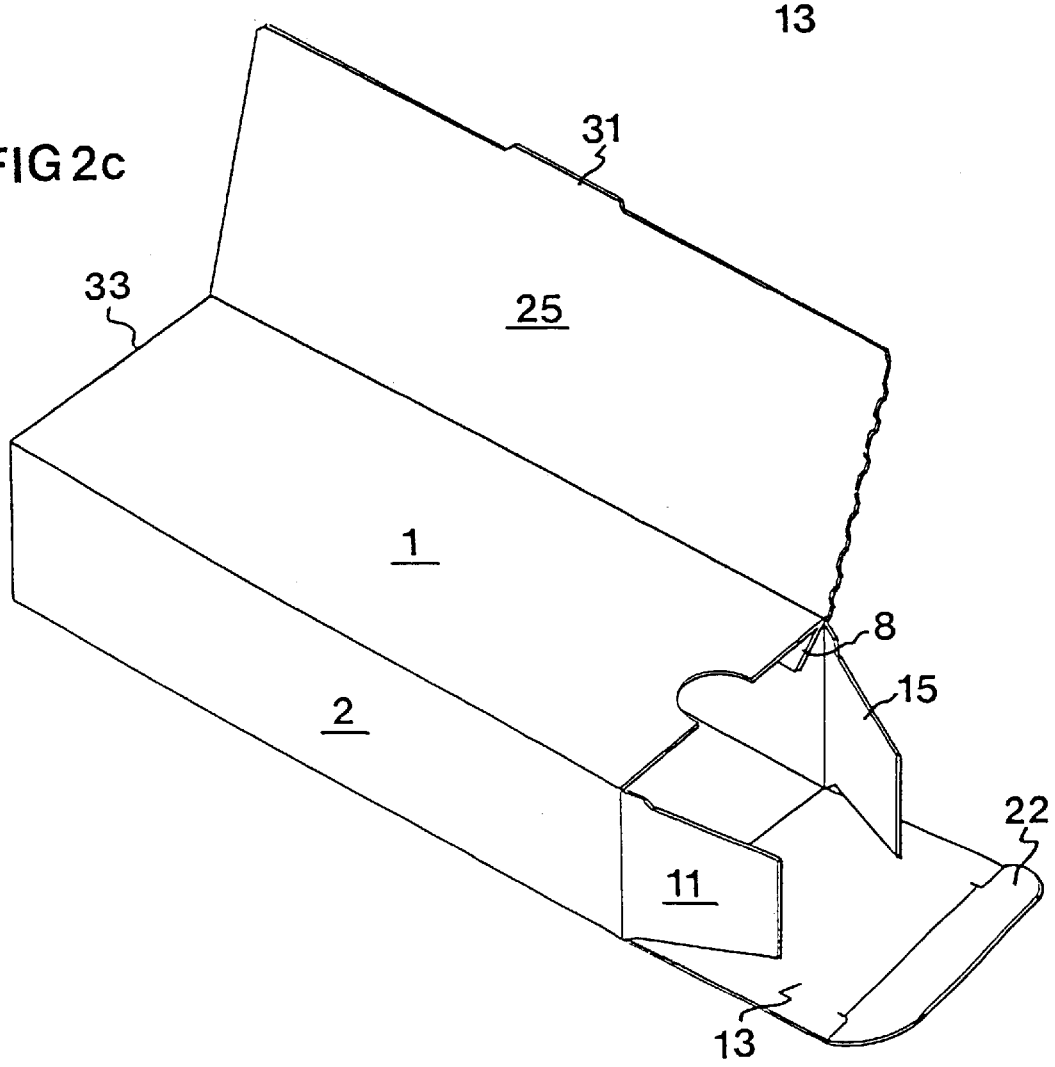
FIG. 2*c* is a perspective view of the carton in FIG. 2*b* after opening.

In FIGS. 2*a*–*c*, a second preferred embodiment is shown. As compared with FIG. 1, like elements have been given like reference numerals.

The blank of the second embodiment, as shown in FIG. 2*a*, differs from the blank of the first embodiment in that it has only one securing flap 28, which is connected along a break line 30 to one end of the additional panel 25. Further, an end flap 32 is, on the opposite end of the blank, connected along a folding line 33 to the top wall panel 1. This end flap 32 has essentially the same dimensions as the end flap 12 of the bottom wall panel 4.

The carton is assembled in a similar manner as the carton of the first embodiment. First, the closure tab 8 is brought into engagement with the second sidewall panel 6. Second, the carton is erected to form a sleeve, whereupon one end of the sleeve is closed by first folding in the end flaps 10, 14 of the sidewall panels 2, 6 and then folding in the end flap 12 of the bottom wall panel 4. Finally, the end flap 32 of the top wall panel 1 is folded down so as to overlie and be fixed to the end flap 12 of the bottom wall panel 4, preferably by means of adhesive.

After being loaded with goods, the carton is closed by first folding in the end flaps 11, 15 of the sidewall panels 2, 6 and then folding in the tuck-in tab 22. Finally, the additional panel 25 is folded onto the top wall panel 1, whereupon the securing flap 28 is folded so as to overlie and be fixed to the end flap 13 carrying the tuck-in tab 22, preferably by means of adhesive.

From FIG. 2*b*, which shows the carton in erected and sealed condition, it is evident that the carton is tamper-proof.

The carton in FIG. 2*b* is opened in the same manner as the embodiment of FIG. 1*b*, and a carton that has been thus opened is shown in FIG. 2*c*.

Apart from having the same advantages as the first embodiment, the carton of the second embodiment confers the further advantage that it can be completely sealed off even after the patient has broken said break line 30. From FIG. 1*c*, it is apparent that the carton of the first embodiment, once opened, provides on the end opposite to the tuck-in tab 22 a gap between the top wall panel 1 and the end flaps 10, 12, 14. In the second embodiment, the end flap 32 of the top wall panel 1 seals off this gap at all times. Thus, there is no risk that particles or dust will enter the carton.

In both embodiments shown, an additional fixing means, such as a string or dots of adhesive, could be used to bring the additional panel 25 into engagement with the top wall 1. Evidently, the additional fixing means could allow the additional panel 25 to be releasably attached to the top wall 1. Thus, the information on the additional panel 25 and the top wall 1 can be concealed when it is not being consulted.

In one embodiment (not shown), the additional panel lacks securing flaps. In this case, an additional fixing means must be provided to bring the additional panel into engagement with the top wall. This kind of carton could increase the patient's compliance with the user instructions and alleviate the risk that these instructions are lost during use. However, this embodiment has the disadvantage of not being tamper-proof prior to delivery.

In one preferred embodiment, the carton according to the invention is used for carrying medication for the treatment of coronary diseases, said medication being for instance a combination of at least one beta blocker, preferably metoprolol or isosorbidmononitrate, and at least one anti-inflammatory substance, preferably acetylsalicylic acid. Another suitable combination is a beta blocker, such as metoprolol or isosorbidmononitrate, and a lipid lowering substance, such fluvastatin.

In another preferred embodiment, the carton according to the invention is used for carrying medication for treatment of *Helibacter pylori*, e.g. a combination of an acid-secretion-inhibiting substance, preferably omeprazole, and at least one antibacterial substance, such as one or more selected from the following antibiotics: clarithromycin, erythromycin, roxithromycin, azithromycin, amoxicillin, metronidazole, tinidazole and tetracycline. A combination of omeprazole with clarithromycin and/or metronidazole is especially suitable.

We claim:

1. A blank for forming a carton, comprising:

a sleeve-forming portion having at least three wall-forming panels (1, 2, 4, 6) arranged side by side and interconnected by folding lines (3, 5, 7), a closure tab (8) connected along a folding line (9) to a first wall-forming panel on one side of the sleeve-forming portion in order to engage a second wall-forming panel (6) on the other side of the sleeve-forming portion when the carton is erected, end flaps (10, 11, 12, 13, 14, 15) connected to the ends of the sleeve-forming portion along folding lines (16, 17, 18, 19, 20, 21) in order to close the ends of the erected carton, an additional panel (25), which is connected along a folding line (26) to said second wall-forming panel (6) and is adapted to overlie at least one of the wall-forming panels (1, 2, 4, 6) when the carton is erected, wherein the additional panel (25) has at least one securing flap (27, 28), each securing flap (27, 28) being connected along a break line (29, 30) to one end of the additional panel (25) and adapted to fixedly engage one of said end flaps (10, 12, 14; 11, 13, 15) when the carton is erected, to make said carton tamper-proof, and wherein if the additional panel (25) has only one securing flap (28) on one side of the blank, the wall-forming panel (1, 6) adapted to underlie the additional panel (25) when the carton is erected at the opposite side of the blank is connected to an end flap (32) along a fold line (33), said end flap (32) being adapted to be fixed to the end flap (12) when the carton is erected, to make said carton tamper-proof.

2. A blank as claimed in claim 11, wherein a tuck-in tab (22) is connected along a folding line (23) to at least one of said end flaps (10, 11, 12, 13, 14, 15).

3. A blank as claimed in claim 2, wherein said at least one securing flap (27, 28) is adapted to overlie the end flap (13) that is connected to said tuck-in tab (22).

4. A blank as claimed in any one of claims 1–3, wherein the additional panel (25) is adapted to overlie said first wall-forming panel (1) when the carton is erected.

5. A blank as claimed in any one of claims 1–3, wherein said additional panel (25) has a lug (31) on the side opposite to said folding line (26).

6. A blank as claimed in any one of claims 1–3, wherein the additional panel (25) has the same dimensions as or smaller dimensions than the underlying wall-forming panel (1, 6).

7. A carton comprising a sleeve portion consisting of at least three wall-forming panels (1, 2, 4, 6) which are interconnected by folding lines (3, 5, 7) and by a closure tab (8), which is attached to a first wall-forming panel (1) along a folding line (9) and engages a second wall-forming panel (6), end flaps (10, 11; 12, 13; 14, 15) attached to the ends of the sleeve portion along folding lines (16, 17,18, 19, 20, 21) and closing the ends of the sleeve portion, an additional panel (25), which is connected to one of the wall-forming panels (1, 2, 4, 6) along a folding line (26) and which overlies at least one of the wall-forming panels (1, 2, 4, 6), wherein the additional panel (25) has at least one securing flap (27, 28), said securing flap (27, 28) being connected along a break line (29, 30) to one end of the additional panel (25) and fixedly engaging one of said end flaps (10, 12, 14; 11, 13, 15) to make said carton tamper-proof, and wherein if the additional panel (25) has only one securing flap (28) at one end of the carton, the wall-forming panel (1, 2, 4, 6) underlying the additional panel (25), at the opposite end of the carton is connected to an end flap (32) along a fold line (33), said end flap (32) being fixed to the end flap (12) to make said carton tamper-proof.

8. A carton as claimed claim 7, wherein a tuck-in tab (22) is connected along a folding line (23) to at least one of said end flaps (10, 11; 12, 13; 14, 15).

9. A carton as claimed in claim 8, wherein said at least one securing flap (27, 28) overlies the end flap (13) that is connected to said tuck-in tab (22).

10. A carton as claimed in any one of claims 7–9, wherein the folding line (26) of the additional panel (25) coincides with one of the folding lines (3, 5, 7; 16, 17, 18, 19, 20, 21) of the sleeve portion.

11. A carton as claimed in any one of claims 7–9, wherein the additional panel (25) overlies said first wall-forming panel (1).

12. A carton as claimed in any one of claims 7–9, wherein said additional panel (25) has a lug (31), which is formed on the additional panel (25) opposite to the folding line (26) and protrudes from the carton.

13. A carton as claimed in any one of claims 7–9, wherein the additional panel (25) has the same dimensions as or smaller dimensions than the underlying wall-forming panel (1, 2, 4, 6).

14. A method for carrying a pharmaceutically active substance comprising placing said substance into a carton as claimed in any one of claims 1–3 or 7–9.

15. A method as claimed in claim 14, wherein said substance is an acid-secretion-inhibiting substance.

16. A method as claimed in claim 14 for carrying as system of drugs that should be administered in combination.

17. A method as claimed in claim 16, wherein said system of drugs comprises at least one beta blocker and at least one anti-inflammatory substance.

18. A method as claimed in claim 16, wherein said system of drugs comprises an acid-secretion-inhibiting substance and one or more antibacterial substances.

* * * * *

UNITED STATES PATENT AND TRADEMARK OFFICE

CERTIFICATE OF CORRECTION

PATENT NO. : 5,971,261
DATED : October 26,1999
INVENTOR(S) : Grunfeld et al.

It is certified that error appears in the above-identified patent and that said Letters Patent is hereby corrected as shown below:

Claim 2 col. 5, line 34, delete "claim 11" and insert therefor --claim 1 --.

Signed and Sealed this

Sixteenth Day of May, 2000

*Attest:*

Q. TODD DICKINSON

*Attesting Officer*

*Director of Patents and Trademarks*